US009770921B2

(12) United States Patent
Inoue et al.

(10) Patent No.: US 9,770,921 B2
(45) Date of Patent: Sep. 26, 2017

(54) HIGH-FREQUENCY DIELECTRIC HEATING DEVICE AND IMAGE FORMING APPARATUS

(71) Applicants: Yukie Inoue, Kanagawa (JP); Dan Ozasa, Kanagawa (JP)

(72) Inventors: Yukie Inoue, Kanagawa (JP); Dan Ozasa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/254,872

(22) Filed: Sep. 1, 2016

(65) Prior Publication Data

US 2017/0066254 A1 Mar. 9, 2017

(30) Foreign Application Priority Data

Sep. 3, 2015 (JP) ..... 2015-174068

(51) Int. Cl.

| | |
|---|---|
| ***B41J 11/00*** | (2006.01) |
| ***H05B 6/64*** | (2006.01) |
| ***H05B 6/50*** | (2006.01) |
| ***H05B 6/60*** | (2006.01) |
| ***H05B 6/54*** | (2006.01) |
| ***H05B 6/62*** | (2006.01) |

(52) U.S. Cl.

CPC ..... *B41J 11/002* (2013.01); *H05B 6/50* (2013.01); *H05B 6/54* (2013.01); *H05B 6/60* (2013.01); *H05B 6/62* (2013.01)

(58) Field of Classification Search

CPC . B41J 11/002; H05B 6/54; H05B 6/62; H05B 6/60; H05B 6/50

See application file for complete search history.

(56) References Cited

U.S. PATENT DOCUMENTS

2008/0266012 A1* 10/2008 Yahata ..... H03H 7/40 331/177 R

FOREIGN PATENT DOCUMENTS

| | | |
|---|---|---|
| JP | 2006-023608 | 1/2006 |
| JP | 2008-270112 | 11/2008 |
| JP | 2009-133515 | 6/2009 |
| JP | 2014-217989 | 11/2014 |

* cited by examiner

*Primary Examiner* — Bradley Thies

(74) *Attorney, Agent, or Firm* — Duft Bornsen & Fettig LLP

(57) ABSTRACT

A high-frequency dielectric heating device includes: a high-frequency generating unit to generate a high-frequency electric field; multiple power amplifiers configured to amplify the high-frequency electric field; multiple electrode sections to apply the amplified high-frequency electric field to each of divided areas on a heated material; multiple matching units to detect an incident wave and a reflected wave between the power amplifiers and the electrode sections, respectively, and conduct impedance matching; multiple voltage detecting units to detect a voltage of each of the electrode sections; and a controller to control at least any of the high-frequency generating unit and the power amplifiers in accordance with a voltage, detected by the voltage detecting units, and control a setting for the matching unit such that a reflected wave, detected by the matching unit, is zero in accordance with an incident wave and a reflected wave that are detected by the matching unit.

7 Claims, 6 Drawing Sheets

HIGH-FREQUENCY DIELECTRIC HEATING DEVICE AND IMAGE FORMING APPARATUS

CROSS-REFERENCE TO RELATED APPLICATIONS

The present application claims priority under 35 U.S.C. §119 to Japanese Patent Application No. 2015-174068, filed Sep. 3, 2015. The contents of which are incorporated herein by reference in their entirety.

BACKGROUND OF THE INVENTION

1. Field of the Invention

The present invention relates to a high-frequency dielectric heating device and an image forming apparatus.

2. Description of the Related Art

As the printing speed of commercial inkjet printers is further increasing, there is a need to dry images, formed on a recording medium such as a sheet by using ink, at a high speed. To dry images, formed by using ink, at a high speed, it is known to use, for example, a high-frequency dielectric heating technique that uses the difference in dielectric loss.

Furthermore, Japanese Unexamined Patent Application Publication No. 2014-217989 discloses an inkjet device that includes a dielectric heating oscillator, which generates a high-frequency voltage, and a dielectric heating unit that includes multiple electrodes, which are arranged in parallel and to which a high-frequency voltage is applied.

However, conventionally, as heat is uniformly applied to a printed material where the amount of ink is different from area to area, insufficient drying or excessive drying of ink occurs so that the print quality is degraded, or as a high-frequency voltage is applied to an area where there is no ink or the area that is dried enough so that unnecessary electric power is consumed.

In view of the foregoing, there is a need to provide a high-frequency dielectric heating device and an image forming apparatus that make it possible to reduce the power consumption without degrading the print quality.

SUMMARY OF THE INVENTION

According to exemplary embodiments of the present invention, there is provided a high-frequency dielectric heating device comprising: a high-frequency generating unit configured to generate a high-frequency electric field; multiple power amplifiers configured to amplify the high-frequency electric field, generated by the high-frequency generating unit; multiple electrode sections configured to apply the high-frequency electric field, amplified by the power amplifiers, to each of divided areas on a heated material; multiple matching units configured to detect an incident wave and a reflected wave between the power amplifiers and the electrode sections, respectively, and conduct impedance matching; multiple voltage detecting units configured to detect a voltage of each of the electrode sections; and a controller configured to control at least any of the high-frequency generating unit and the power amplifiers in accordance with a voltage, detected by each of the voltage detecting units, and control a setting for the matching unit such that a reflected wave, detected by the matching unit, is zero in accordance with an incident wave and a reflected wave that are detected by the matching unit.

Exemplary embodiments of the present invention also provide an image forming apparatus comprising: an image forming unit configured to form an image on a recording medium by using ink; and the above-described high-frequency dielectric heating device, where the heated material is a recording medium on which an image is formed by the image forming unit.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
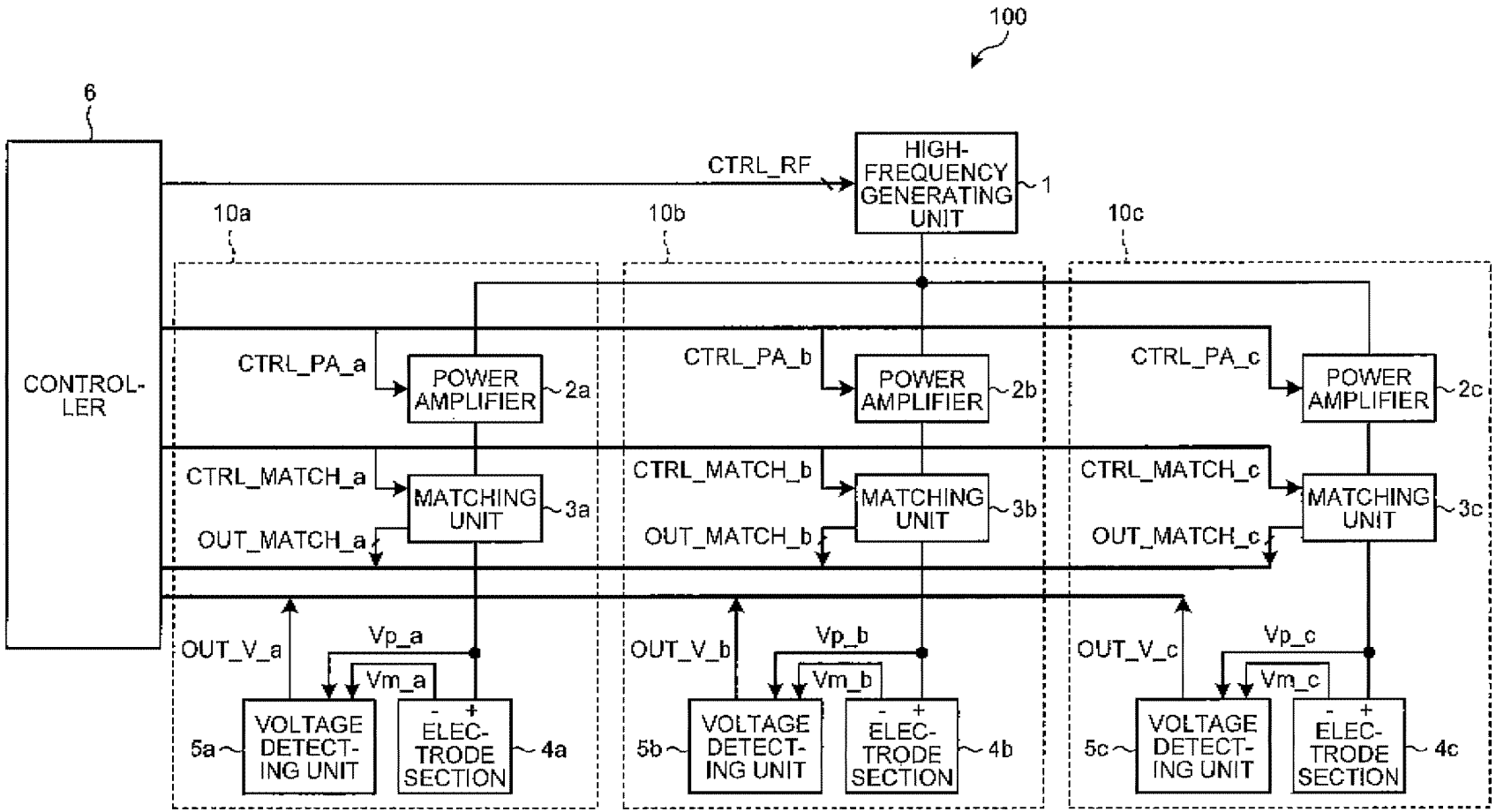
FIG. 1 is a block diagram that illustrates an example of the outline of a high-frequency dielectric heating device according to an embodiment of the present invention.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

Next, an explanation is given of a high-frequency dielectric heating device according to an embodiment of the present invention with reference to the attached drawings. FIG. 1 is a block diagram that illustrates an example of the outline of a high-frequency dielectric heating device 100 according to the embodiment. As illustrated in FIG. 1, the high-frequency dielectric heating device 100 includes a high-frequency generating unit 1, heating units 10*a* to 10*c*, and a controller 6, and it is used in, for example, an image forming apparatus, as described later with reference to FIG. 6. Hereinafter, an explanation is given of a case where, for example, the high-frequency dielectric heating device 100 is used in an image forming apparatus.

Under the control of the controller 6, the high-frequency generating unit 1 generates a high-frequency electric field with any frequency, amplitude, or phase. For example, the high-frequency generating unit 1 conducts sleep/active controls, frequency controls, amplitude controls, phase controls, or the like, with a control signal CTRL_RF from the controller 6.

The heating units 10*a* to 10*c* have the same configuration, and they are arranged in parallel. Hereafter, if any of the components, such as the heating units 10*a* to 10*c*, are described without being specified, they are sometimes abbreviated as "the heating unit 10", for example. Each of the heating units 10 includes a power amplifier 2, a matching unit 3, an electrode section 4, and a voltage detecting unit 5.

Power amplifiers 2*a* to 2*c* amplify the high-frequency electric field, generated by the high-frequency generating unit 1, and output it to matching units 3*a* to 3*c*, respectively. For example, the power amplifiers 2*a* to 2*c* conduct sleep/active controls and output power changes with a control signal CTRL_PA from the controller 6. Here, the controller 6 may control output of the high-frequency generating unit 1 without performing an output power control of the power amplifiers 2*a* to 2*c*.

The matching units 3*a* to 3*c* include a matching device that detects an incident wave and a reflected wave between the power amplifiers 2*a* to 2*c* and electrode sections 4*a* to 4*c*, respectively, and that conducts impedance matching. The amount of ink (image), which is applied to a recording medium (medium) such as a sheet that is a heated material, is not the same due to a change in patterns. Therefore, the impedance of the sheet, on which an image is formed, is changed from the perspective of the electrode section 4.

Furthermore, if a heated subject, such as water, is dried and reduced, the subject that absorbs power is reduced; therefore, in this aspect, too, the impedance is changed. Thus, the matching unit 3 uses a directional coupler to detect an incident wave and a reflected wave, and it outputs a detection result OUT_MATCH of the amplitude or the phase difference to the controller 6. Furthermore, the matching unit 3 adjusts the value of the variable capacitor or the variable inductor, included in the matching device, such that reflected waves are zero and the impedance is matched in response to a control signal CTRL_MATCH that is output from the controller 6.

In the electrode sections 4*a* to 4*c*, multiple units are arranged in parallel, where, for example, a single unit includes equal to or more than one pair of a positive electrode and a negative electrode, and each electrode applies the high-frequency electric field, amplified by the power amplifiers 2*a* to 2*c*, to each of the divided areas on the heated material. That is, if the size of each electrode in the electrode section 4 is small, the area for matching is small; therefore, high-accuracy matching may be achieved. The detailed configuration of the electrode is described later.

Voltage detecting units 5*a* to 5*c* detect voltages, i.e., a plus-side voltage Vp and a minus (GND)-side voltage Vm of an electrode (an electrode 70 that is described later with reference to FIG. 2, or the like), outputs the potential difference as an interelectrode voltage OUT_V to the controller 6, and detects the amplitude of the voltage, applied between the electrodes. As the interelectrode voltage is changed due to the impedance of the load, the approximate state of the load may be estimated.

Furthermore, if the area, which is the matching target for the matching units 3*a* to 3*c*, is made small, and the electrode is made small in order to conduct high-accuracy control on the high-frequency output from an electrode, the space between a positive electrode and a negative electrode is narrow, and electric discharge easily occurs. If a spark occurs due to the electric discharge, there is a possibility that a medium gets damaged, or the high-frequency generating unit 1, the power amplifiers 2*a* to 2*c*, or the matching units 3*a* to 3*c*, get damaged due to an abnormal current flow.

Therefore, the controller 6 uses the voltage (voltage amplitude), detected by the voltage detecting units 5*a* to 5*c*, to control the input electric power such that it keeps equal to or less than the threshold voltage that is set to be equal to or less than the voltage with which an electric discharge occurs between the positive electrode and the negative electrode. Furthermore, the controller 6 may be configured to determine whether an electric discharge occurs in any of the electrode sections 4 on the basis of the voltage that is detected by the voltage detecting units 5*a* to 5*c* and, if it is determined that an electric discharge occurs, stops at least any of the high-frequency generating unit 1 and the power amplifiers 2*a* to 2*c*.

That is, the controller 6 is a control unit of the high-frequency dielectric heating device 100, and the controller 6 conducts sleep/active controls, signal measurement, and various setting value changes, or the like, on each unit that is included in the high-frequency dielectric heating device 100. For example, the controller 6 controls at least any of the high-frequency generating unit 1 and the power amplifiers 2 based on the voltage that is detected by each of the voltage detecting units 5, and the controller 6 controls the settings for each of the matching units 3 such that the reflected waves, detected by the matching unit 3, are zero based on the incident wave and the reflected wave, detected by the matching unit 3.

Figure 2:
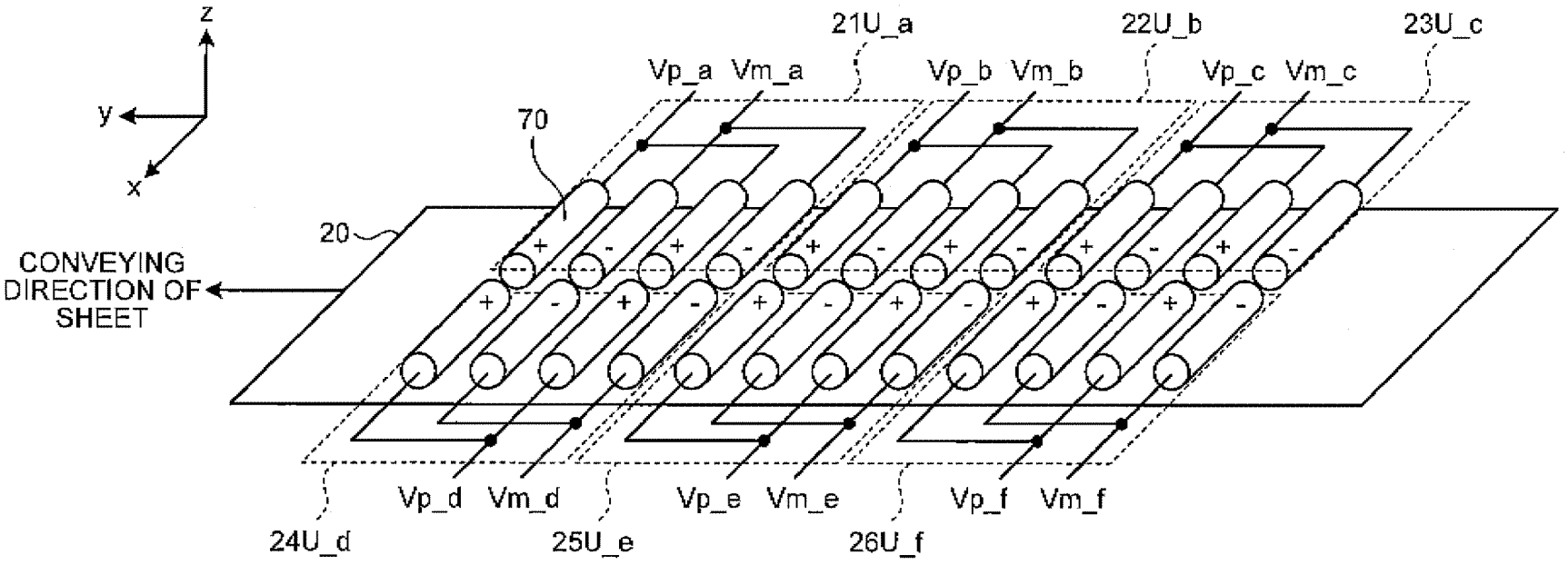
FIG. 2 is a diagram that illustrates a first embodiment of an electrode section.

Next, an example of the configuration of the electrode section 4 is explained. FIG. 2 is a diagram that illustrates a first embodiment of the electrode section 4. In the electrode section 4, the electrodes 70 are arranged in a conveying direction (the y-axis direction) of a medium (sheet) 20 and in the x-axis direction. More specifically, the electrode section 4 is divided into electrode units 21U_a to 26U_f, and each of the electrode units 21U_a to 26V_f is connected to the matching unit 3 and the high-frequency generating unit 1. The cross-sectional surface of the electrode 70 may be a circle, a square, or the like.

The positive electrode 70 is connected to the power amplifier 2 and the matching unit 3, corresponding to each of the electrode units 21U_a to 26U_f, and the negative electrode 70 is connected to the GND. In each of the electrode units 21U_a to 26U_f, the positive and negative electrodes 70 are alternately arranged in the y-axis direction, and the four electrodes 70 constitute a single unit. Furthermore, the six electrode units 21U_a to 26U_f are provided such that they cover the sheet surface of the medium 20.

Figure 3:
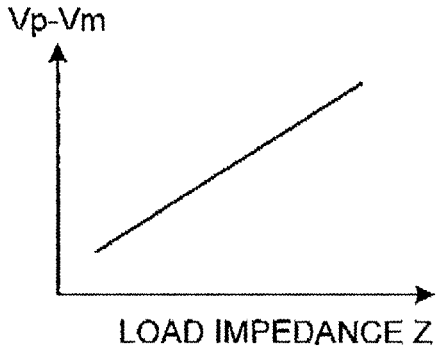
FIG. 3 is a graph that illustrates the relation between the load impedance and the interelectrode voltage in an electrode unit.

FIG. 3 is a graph that illustrates the relation between the load impedance and the interelectrode voltage in one electrode unit (any one of the electrode units 21U_a to 26U_f). While the electric power, input from the power amplifier 2, is constant and the reflected waves are zero due to matching by the matching unit 3, an interelectrode voltage amplitude Vp-Vm is of the voltage that depends on a load impedance Z that is obtained from the load, such as ink or sheet (medium), and the capacitance between the electrodes 70.

Specifically, although the clear straight line, illustrated in FIG. 3, is not obtained, as the load impedance Z increases, the interelectrode voltage amplitude Vp-Vm increases and, as the load impedance Z decreases, the interelectrode voltage amplitude Vp-Vm decreases. Here, if the load impedance Z is low, it means a state where the amount of, ink is relatively large as in solid images and the load is high. Here, the coupling capacitance between the electrode 70 and the ink is relatively high, and the overall load impedance Z is low from the perspective of the electrode 70. Conversely, if the load impedance Z is high, it means a state where the amount of ink is small and the load is low. Here, the coupling capacitance between the electrode 70 and the sheet is relatively low, and the overall load impedance Z is high from the perspective of the electrode 70.

Next, the control performed by the controller 6 is explained in detail. The controller 6 performs control in accordance with a load change. Specifically, if the sheet is passed through from the side of the electrode units 23U_c and 26U_f, the ink is gradually dried, and the load, such as ink or sheet, becomes low (=the load impedance Z becomes high) on the side of the subsequent electrode units 21U_a and 24U_d.

If high-frequency output is controlled with the constant electric power, the load is high (=the load impedance Z is low) and the interelectrode voltage amplitude Vp-Vm is low on the side of the electrode unit 23U_c (or 26U_f) where there is no dryness. Conversely, the load is lower (=the load impedance Z is higher) and the interelectrode voltage amplitude Vp-Vm is higher on the side of 21U_a (or 24U_d), where the ink is dried.

The controller 6 monitors the interelectrode voltage and adjusts the output electric power, thereby performing output power control in accordance with a load change due to a change in the ink drying state. Thus, the high-frequency dielectric heating device 100 may prevent a reduction in the print quality and may reduce the power consumption. Especially, the controller 6 controls the output electric power of the high-frequency generating unit 1 or the power amplifier 2 such that the interelectrode voltage does not exceed the threshold for electric discharge, whereby the space between the electrodes may be made small, and the control accuracy may be improved.

Furthermore, the controller 6 reduces the power consumption in accordance with the arrangement of the electrodes 70. For example, the controller 6 specifies the output settings of the power amplifiers 2 such that the supplied electric power is reduced with respect to the conveying direction of the sheet in order from the electrode units 23U_c, 22U_b, and then 21U_a (or the electrode units 26U_f, 25U_e, and then 24U_d).

Specifically, the controller 6 sets the power of the electrode unit 23U_c, where the ink is least dried, to be high, sets the power of the electrode unit 22U_b, where the ink is dried medium, to be medium, and sets the power of the electrode unit 21U_a, where the ink is most dried, to be low. Furthermore, the controller 6 sets the power of the electrode unit 26U_f, where the ink is least dried, to be high, sets the power of the electrode unit 25U_e, where the ink is dried medium, to be medium, and sets the power of the electrode unit 24U_d, where the ink is most dried, to be low. In this way, the high-frequency dielectric heating device 100 supplies the electric power in accordance with the degree of dryness, thereby reducing the power consumption.

Furthermore, the controller 6 performs a control in accordance with a print pattern. If the high-frequency dielectric heating device 100 is provided in the image forming apparatus, the type or the density of ink on a medium that is conveyed under each of the electrodes 70, the conveying speed of a medium, and the distance from a printing unit, such as an inkjet head, to each of the electrode units 21U_a to 26U_f are previously defined.

Therefore the controller 6 changes the output power of each of the electrode units 21U_a to 26U_f in accordance with a condition, such as the ink or the conveying speed. The controller 6 controls output of each of the electrode units 21U_a to 26U_f with the control signal CTRL_PA of the power amplifiers 2*a* to 2*c* such that there is no output for a blank area where there is no print pattern and such that there is a high output for a solid pattern area. That is, the controller 6 controls at least any of the high-frequency generating unit 1, the power amplifiers 2*a* to 2*c*, and the matching units 3*a* to 3*c* on the basis of the correspondence information (image information) that corresponds to the distribution of different relative permittivity (the ink distribution, or the like) of the heated material.

Thus, the high-frequency dielectric heating device 100 may prevent a reduction in the print quality due to insufficient drying and excessive drying and may reduce the power consumption. Specifically, as described above, the high-frequency dielectric heating device 100 sets the output power in accordance with the order of arrangement of the electrode 70, and it makes output to the electrode units 21U_a to 26U_f in order in accordance with the conveying direction of the sheet such that the output is ON when the print pattern passes through each of the electrodes 70.

Figure 4:
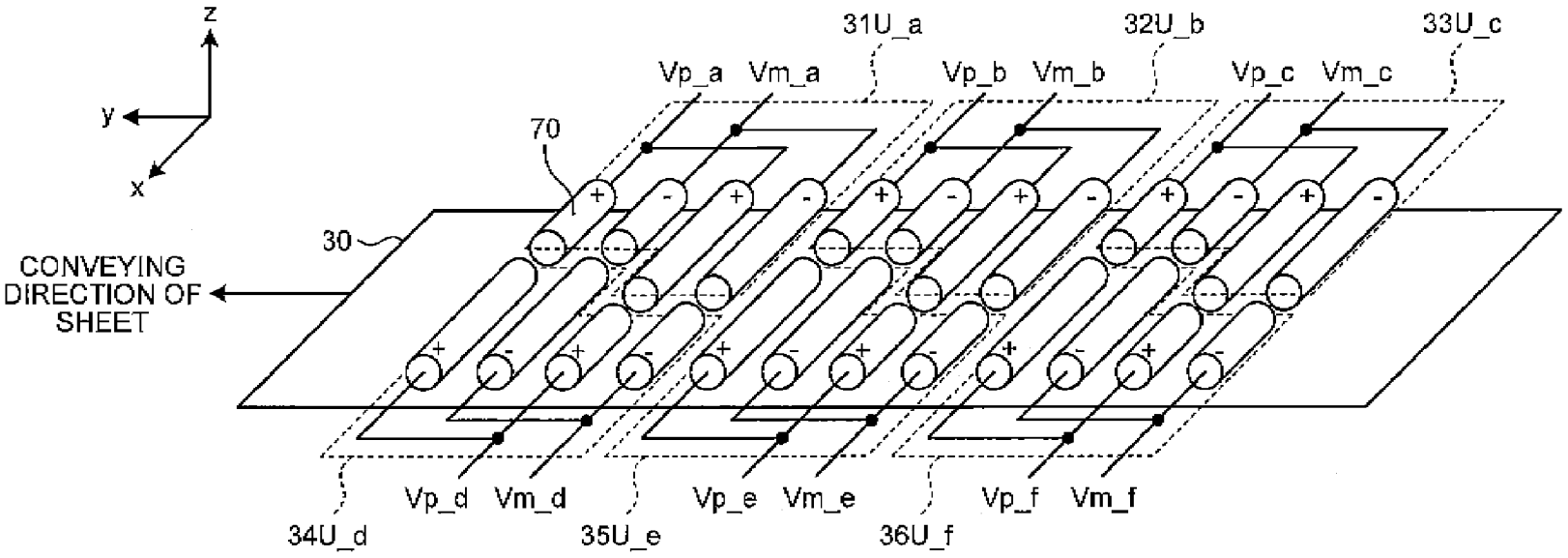
FIG. 4 is a diagram that illustrates a second embodiment of the electrode section.

FIG. 4 is a diagram that illustrates a second embodiment of the electrode section 4. According to the second embodiment of the electrode section 4, there is a difference in the lengths of the electrodes 70. In the electrode section 4, if a space with respect to the x-axis direction occurs in the y-axis direction in a uniform manner, a sheet (a medium 30) has an area that is not dried because a high-frequency is not applied. Therefore, according to the second embodiment of the electrode section 4, in electrode units (e.g., an electrode unit 31U_a and an electrode unit 34U_d), which face to each other in the x-axis direction, the electrodes 70 have unequal lengths with respect to the x-axis direction. Specifically, the electrode sections 4*a* to 4*c* according to the second embodiment are provided such that a linear space is not formed in a predetermined direction.

Here, the positive electrodes 70 or the negative electrodes 70 are opposed to each other in the x-axis direction. If the length of the electrode 70 in the x-axis direction is extremely large in the opposing electrode units, the area under the electrode 70 is increased, and the matching target area and the high-frequency applied area are increased, which sometimes results in a coarse control. According to the second embodiment of the electrode section 4, the length of the electrode 70 in the x-axis direction is somewhat small in the opposing electrode units, and power control and matching may be precisely conducted in small areas.

Figure 5:
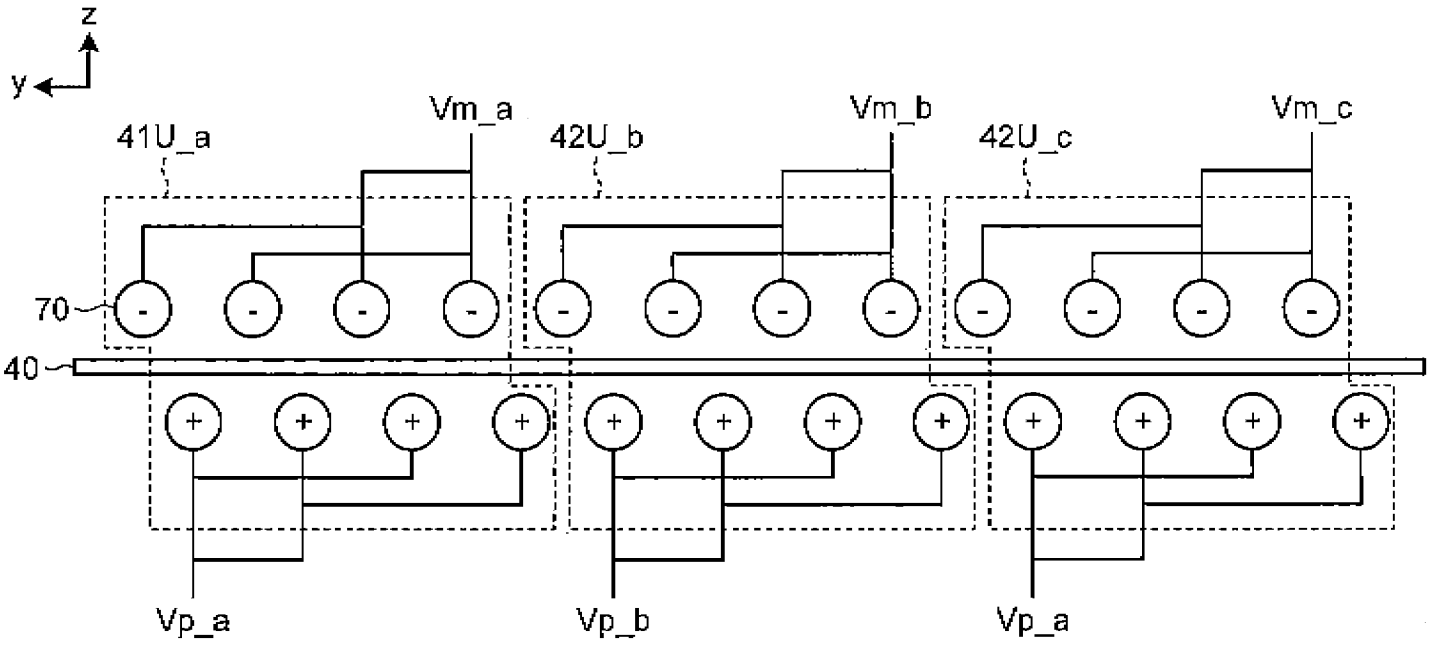
FIG. 5 is a diagram that illustrates a third embodiment of the electrode section.

FIG. 5 is a diagram that illustrates a third embodiment of the electrode section 4. It is generally known that, in high-frequency dielectric heating devices, as the number of lines of electric force, passing through the heated material, is larger, heating is more likely to happen. Therefore, according to the third embodiment of the electrode section 4, the electrodes 70 of electrode units 41U_a to 42U_c are arranged alternately (in zigzags) with a medium 40, such as a sheet, interposed therebetween. That is each of the electrode sections 4*a* to 4*c* according to the third embodiment includes the electrodes 70 in pairs, and it is provided such that the heated material may be passed through the electrodes 70 in pairs. Furthermore, the efficiency is improved in a case where the arrangement of the electrodes 70 is set on the yz plane as in the third embodiment of the electrode section 4, as compared to a case where the electrodes 70 are provided an only one side of the medium as in the first embodiment and the second embodiment of the electrode section 4.

Figure 6:
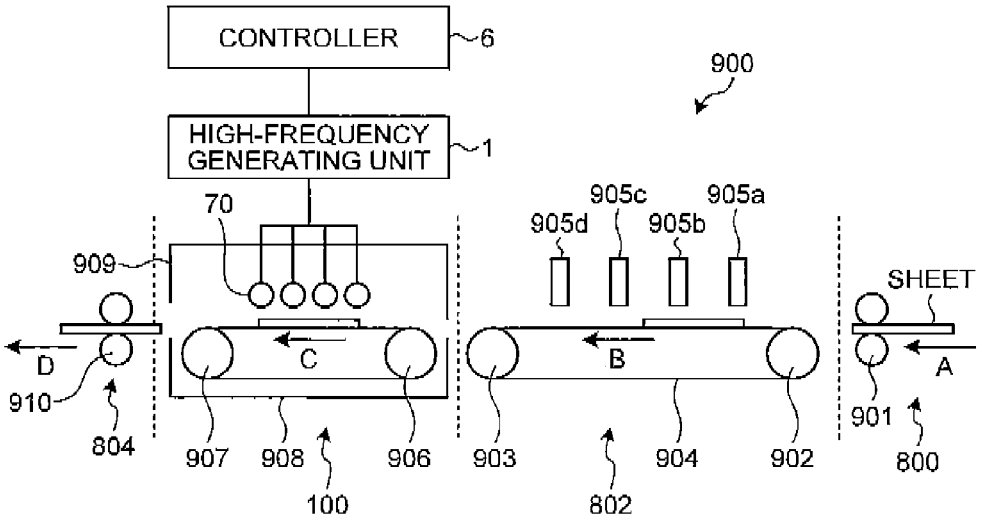
FIG. 6 is a diagram that schematically illustrates an image forming apparatus that includes the high-frequency dielectric heating device.

Next, an explanation is given of an image forming apparatus 900 that includes the high-frequency dielectric heating device 100. FIG. 6 is a diagram that schematically illustrates the image forming apparatus 900 that includes the high-frequency dielectric heating device 100. The image forming apparatus 900 is for example an inkjet type image forming apparatus, and it includes a sheet feeding unit 800, an image forming unit 802, the high-frequency dielectric heating device 100 as a fixing unit, and a paper ejection unit 804.

The sheet feeding unit 800 feeds a sheet (medium) from a sheet feeding tray and conveys the sheet to the image forming unit 802 (the direction of the arrow A) by using a pair of rollers 901.

The image forming unit 802 conveys the sheet (the direction of the arrow B) by using a conveyance belt 904 that extends between a drive roller 902 and a driven roller 903 so as to form an unfixed image on the sheet, and then it conveys the sheet to the high-frequency dielectric heating device 100. In the image forming unit 802, recording heads 905*a* to 905*d*, which eject ink of black, cyan, magenta, and yellow, respectively, are sequentially arranged in the conveying direction of the conveyance belt 904. In the recording heads 905*a* to 905*d*, nozzles are formed (line-type recording head) at predetermined intervals over substantially the width of the sheet (recording-sheet surface horizontal direction). Therefore, if the sheet is conveyed to the high-frequency dielectric heating device 100 by the conveyance belt 904, a desired unfixed image is formed on the entire area of the sheet.

In the case of the above-described inkjet type, particularly, if color images are formed, a large amount of ink is ejected from the recording heads 905*a* to 905*d*, and it is difficult to quickly fix images due to ink drying under the normal environment. Therefore, if the ink is delivered to the paper ejection tray in the paper ejection unit 804 while the ink is not dried (unfixed), there are adverse effects, for example, the ink permeates (bleeds through) the back surface of the sheet while being delivered so that images are degraded, or the ink is stained on the back surface of a different sheet in the paper ejection tray (back-surface staining). Furthermore, if the image forming system is an electrophotographic system, the image forming unit 802 forms unfixed toner images on sheets through the known processes of charging, exposure, and developing.

The high-frequency dielectric heating device 100 conveys a sheet (the direction of the arrow C) by using a conveyance belt 908 that extends between a drive roller 906 and a driven roller 907, fixes the image on the sheet by using the electrodes 70 within a main body 909, and then conveys the sheet to the paper ejection unit 804. As the space between each of the electrodes 70 and the sheet may be set to be small and uniform, the high-frequency dielectric heating device 100 is superior in the heat fixing efficiency and the fixing uniformity, and it has a lot of flexibility in setting a high-frequency applied area.

The high-frequency generating unit 1 applies high-frequency voltages, having alternately different polarities, to each of the electrodes 70. Furthermore, the controller 6 conducts on-off control of the high-frequency generating unit 1, the voltage control, or the like. The high-frequency dielectric heating device 100 applies a high-frequency voltage to the electrodes 70, which have different polarities, and conveys a sheet to the electric field that is generated among the electrodes 70, thereby heating the ink itself, water in the sheet, and the sheet itself on the principle of high-frequency dielectric heating.

The paper ejection unit 804 conveys a sheet (the direction of the arrow D) to the paper ejection tray, or the like, by using a pair of rollers 910.

According to the embodiments of the present invention, there is an advantage such that the power consumption may be reduced without degrading the print quality.

The above-described embodiments are illustrative and do not limit the present invention. Thus, numerous additional modifications and variations are possible in light of, the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A high-frequency dielectric heating device comprising:

a high-frequency generating unit configured to generate a high-frequency electric field;

multiple power amplifiers configured to amplify the high-frequency electric field, generated by the high-frequency generating unit;

multiple electrode sections configured to apply the high-frequency electric field, amplified by the power amplifiers, to each of divided areas on a heated material;

multiple matching units configured to detect an incident wave and a reflected wave between the power amplifiers and the electrode sections, respectively, and conduct impedance matching;

multiple voltage detecting units configured to detect a voltage of each of the electrode sections; and a controller configured to control at least any of the high-frequency generating unit and the power amplifiers in accordance with a voltage, detected by each of the voltage detecting units, and control a setting for the matching unit such that a reflected wave, detected by the matching unit, is zero in accordance with an incident wave and a reflected wave that are detected by the matching unit.

2. The high-frequency dielectric heating device according to claim 1, wherein the electrode sections are provided such that a linear space is not formed in a predetermined direction.

3. The high-frequency dielectric heating device according to claim 1, wherein each of the electrode sections includes electrodes in pairs and is provided such that a heated material may be passed between the electrodes in pairs.

4. The high-frequency dielectric heating device according to claim 1, wherein the controller controls at least any of the high-frequency generating unit and the power amplifiers such that an amplitude of a voltage, detected by each of the voltage detecting units, has a predetermined value.

5. The high-frequency dielectric heating device according to claim 1, wherein the controller determines whether an electric discharge occurs in any of the electrode sections in accordance with a voltage, detected by each of the voltage detecting units and, if it is determined that an electric discharge occurs, controls at least any of the high-frequency generating unit and the power amplifiers so as to stop.

6. The high-frequency dielectric heating device according to claim 1, wherein the controller controls at least any of the high-frequency generating unit, the power amplifiers, and the matching units by using correspondence information that corresponds to a distribution of different relative permittivity of a heated material.

7. An image forming apparatus comprising:

an image forming unit configured to form an image on a recording medium by using ink; and the high-frequency dielectric heating device according to claim 1, where the heated material is a recording medium on which an image is formed by the image forming unit.

* * * * *